United States Patent [19]

Hale

[11] 4,093,224

[45] June 6, 1978

[54] NET HOLDING STANCHION ASSEMBLY

[76] Inventor: C. Marion Hale, 8525 Colesville Rd., Silver Spring, Md. 20910

[21] Appl. No.: 665,444

[22] Filed: Mar. 9, 1976

[51] Int. Cl.[2] ..... A63B 61/00

[52] U.S. Cl. ..... 273/95 H; 273/29 BB; 273/102 S

[58] Field of Search ..... 273/1 B, 26 A, 29 B, 273/29 BB, 95 H, 102 S, 127 R, 181 F; 40/125 G, 125 H; 211/205; 248/158, 163, 165, 188.6, 523

[56] References Cited

U.S. PATENT DOCUMENTS

| | | | |
|---|---|---|---|
| 928,674 | 7/1909 | Lenz | 273/26 A |
| 2,490,858 | 12/1949 | Deddo | 248/165 |
| 3,262,703 | 7/1966 | Hodlick | 248/158 X |
| 3,698,712 | 10/1972 | Pero | 273/26 A |
| 3,817,520 | 6/1974 | Burgos | 273/95 H |
| 3,929,334 | 12/1975 | Magazzu | 273/26 A |

FOREIGN PATENT DOCUMENTS

| | | | |
|---|---|---|---|
| 194,207 | 3/1923 | United Kingdom | 273/29 BB |
| 342,410 | 2/1931 | United Kingdom | 273/29 BB |

OTHER PUBLICATIONS

The Sporting Goods Dealer; "Realistic Response from Rebound Net;" Jun. 1972; p. 114.

*Primary Examiner*—Vance Y. Hum

*Attorney, Agent, or Firm*—Cushman, Darby & Cushman

[57] ABSTRACT

A net holding stanchion assembly comprising a vertical support member with a plurality of net fastening members secured thereto at predetermined heights, a base member with a pair of spaced ground engaging support members, a pair of spaced apart cross members fixedly secured to the central portions of the ground engaging support members, with the vertical support member being releasably secured in the upright position between the cross members so that the base member may be removed from the support member for storage, and a T-shaped spike inserted between the cross members to anchor the stanchion assembly to the ground during use.

3 Claims, 4 Drawing Figures

Fig. 1.
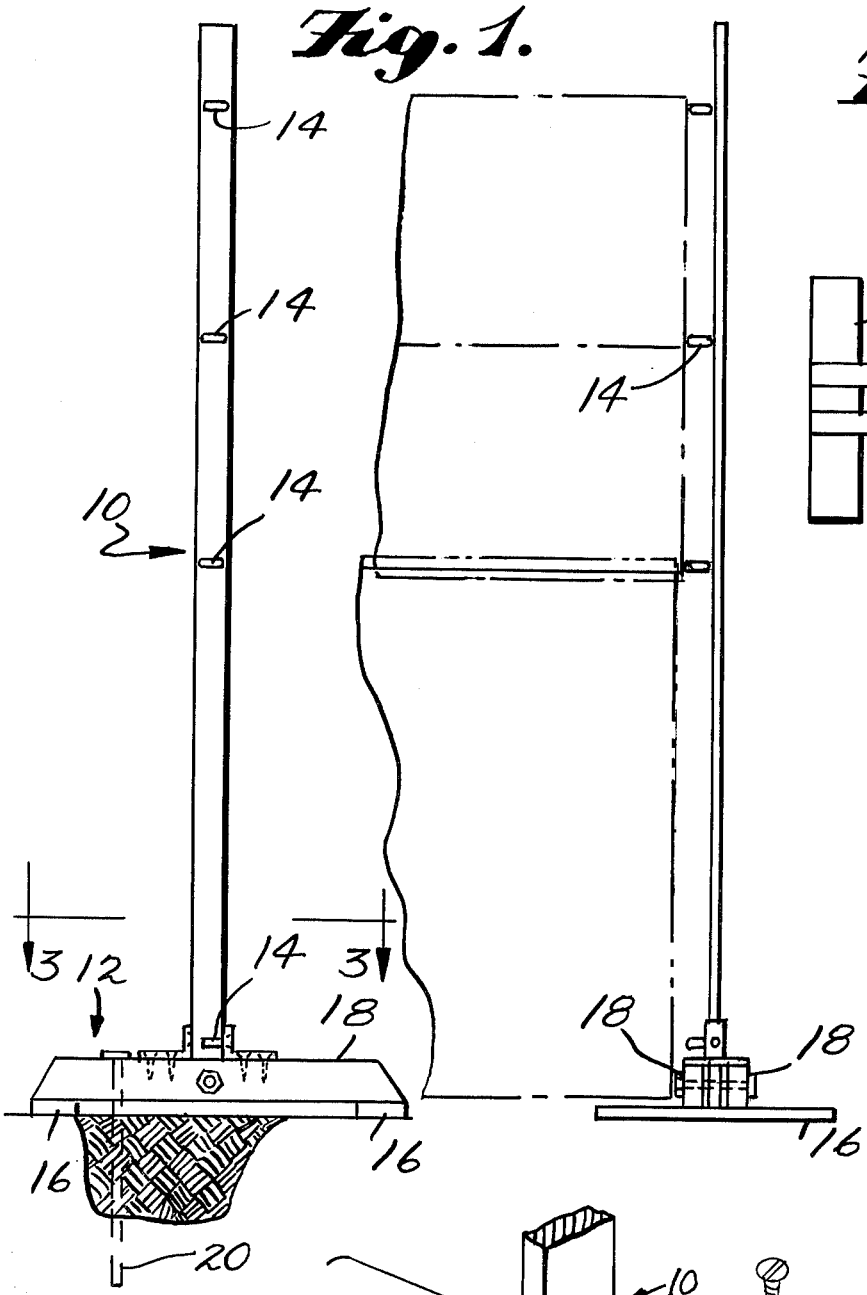
Fig. 2.
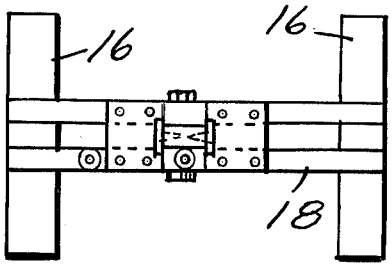
Fig. 3.
Fig. 4.
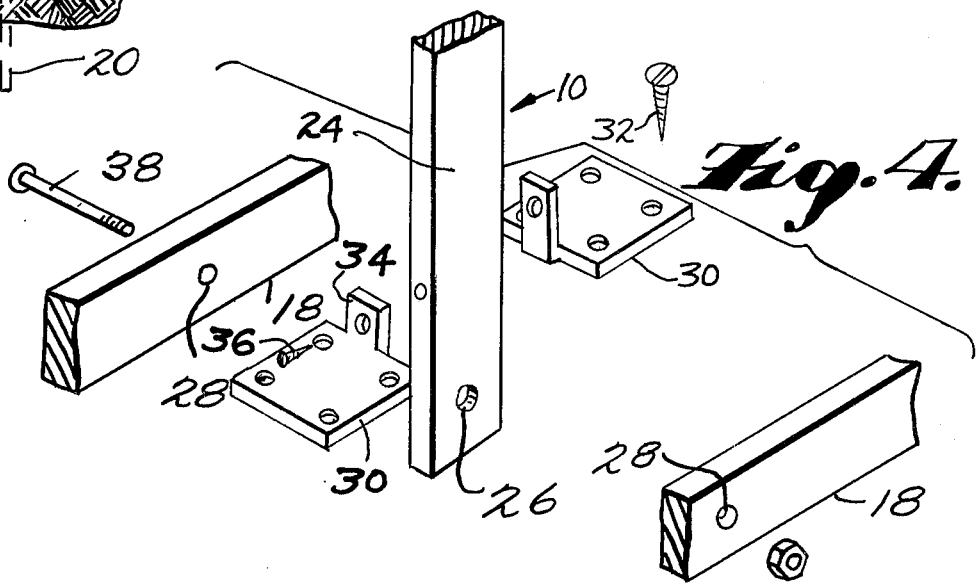

NET HOLDING STANCHION ASSEMBLY

BACKGROUND OF THE INVENTION

1. Field of the Invention

This invention relates to stanchion assemblies, and more particularly, to a stanchion assembly for holding a net at variable heights.

2. Prior Art

Many net holding stanchion assemblies are available for a variety of uses. Most, however, are designed for specific applications, such as solely for tennis, badminton or volleyball, and some are designed to provide a variable height so that the net may be moved up or down to accommodate heights of players or the regulation height of a net for playing a specific game.

Such prior art devices also possess a variety of means for supporting the stanchions in or on the ground to prevent the stanchions from being overturned when a ball or person strikes the net supported by a pair of these stanchions.

SUMMARY OF THE INVENTION

The present invention is a simple and economic net holding stanchion assembly which provides a plurality of fastening levels for a net so that a variety of games can be played using a single pair of these stanchions with fastening members secured thereto at predetermined heights which correspond to the heights necessary for positioning a net for play in the games of tennis, badminton and volleyball.

These advantages are accomplished by the present invention by providing a net holding stanchion assembly having a vertical support member with a plurality of net fastening members secured thereto at predetermined heights; and a base member having a pair of spaced apart parallel ground engaging support members disposed parallel to the direction of the net when connected to the stanchion assembly, a pair of spaced apart parallel cross members fixedly secured at each end thereof to the central portions of the ground engaging support members, the vertical support member being releasably secured in the upright position between the cross members in their central portions; and a T-shaped spike engagable with the upper surfaces of the cross members and extendable into the ground so as to anchor the stanchion assembly to the ground during use.

DETAILED DESCRIPTION OF THE DRAWINGS

FIG. 1 is a side view of the net holding stanchion assembly of the present invention, showing how it is secured to the ground by a T-shaped spike member;

FIG. 2 is a front view of the stanchion assembly of the present invention illustrating the variable positioning of a net on the plurality of fastening members;

FIG. 3 is a cross-sectional plan view along line 3—3 of the stanchion assembly of FIG. 1; and FIG. 4 is an expanded partial pictorial view of the vertical support member and cross members of the invention illustrated in FIG. 1.

DETAILED DESCRIPTION OF THE PREFERRED EMBODIMENT

The net holding stanchion assembly of the present invention is composed mainly of a vertical net support member 10 and a base support member 12. The vertical support member has a plurality of net fastening members 14 preferably in the form of eyelets to which the string or rope connected to the net may be fastened. The vertical support members are preferably made of wood, however, they may be of any suitable material such as aluminum or steel.

The base member 12 consists of a pair of spaced apart parallel ground engaging support members 16 which are disposed parallel to the direction of the net when it is supported between a pair of the stanchion assemblies. The ground engaging support members are to be spaced sufficiently apart to provide a substantial degree of stability to the stanchion assembly when a pair of them are supporting a net.

Secured to the ground engaging support members are a pair of spaced apart parallel cross members 18 fixedly secured at each end thereof to the central portions of the ground engaging support members 16. The ground engaging support members and the cross members are also preferably made of wood and can thus be fastened together by screws or nails.

The spike 20 is in the form of a T-shaped member so that it may be driven into the ground adjacent the vertical support member with the upper portion 22 of the T extending over the upper surfaces of the cross members so as to hold the stanchion firmly on the ground.

Referring to FIG. 4, the lower end portion 24 of the vertical support member 10 has hole 26 which corresponds to hole 28 drilled in the cross members. In addition, a pair of metal members 30 are provided which are secured to the cross members 18 by screws 32. Each of the members has an upper portion 34 which extend up opposite sides of the vertical support member and are securable thereto by removable means such as screws 36 to provide support for the vertical support member. Long bolt 38 is inserted through the cross members through holes 28 and vertical support member through hole 26 to secure the assembly together. During storage, however, the bolt 38 and screws 36 may be removed so that the base member 12 can be removed from the vertical support member.

Where the stanchion assembly of the present invention will be utilized on hard surfaces, the base members provide substantial support, but additional support may be provided by the use of sand bags or cinder blocks or the like laid across the ground engaging members in lieu of the spike 20.

Referring again to the eyelets 14, a first of these is preferably secured to the lower portion 24 of the vertical support member adjacent the upper surfaces of the cross members 18, a second is preferably positioned at least about 3 feet 6 inches above the ground engaging support members 18, a third is preferably positioned at least about 5 feet above the ground engaging support members 18, and a fourth is preferably positioned at least about 6 feet 6 inches above the ground engaging support member. The actual positioning of the eyelets 14 being such that a net can be strung at the appropriate height for playing tennis, badminton and volleyball, respectively, with the lower rope or string of the net being tied to the first eyelet and the upper rope or string of the net being tied to either the second, third or fourth eyelet, depending on what game is to be played.

A preferred embodiment of the net 40 is shown in FIG. 2 and is preferably of conventional construction but has a height of 2 feet 6 inches and a width of 20 feet to accommodate the playing of the three games mentioned.

Although the foregoing is a description of the preferred embodiment of the present invention, it will be apparent to those skilled in the art that variations are possible. All such variations as would be obvious to those skilled in this art are intended to be included within the scope of this invention as defined by the following claims.

What is claimed is:

1. A net holding stanchion assembly comprising: a vertical support member having a plurality of net fastening members secured thereto at predetermined heights;

a base member having a pair of spaced apart parallel ground engaging support members disposed parallel to the direction of a net when connected to the stanchion assembly, a pair of spaced apart parallel cross members fixedly secured at each end thereof to the central portions of the ground engaging support members, the vertical support member being releasably secured in the upright position between the cross members in their central portions;

T-shaped spike means engagable with the upper surfaces of the cross members and extendable into the ground between the cross members so as to anchor the stanchion assembly to the ground during use.

2. A net holding stanchion assembly as defined in claim 1 wherein a first of the net fastening members is secured to the lower portion of the vertical support member adjacent the upper surfaces of the cross members, a second of the net fastening members is secured to the vertical support member at least about 3 feet 6 inches above the ground engaging support members, a third of the net fastening members is secured to the vertical support member at least about 5 feet above the ground engaging support members and a fourth of the net fastening members is secured to the vertical support member at least about 6 feet 6 inches above the ground engaging support members.

3. A pair of net holding stanchion assemblies as defined in claim 1 and supporting a net from at least two of the net fastening members.

* * * * *